US010474059B2

(12) United States Patent
Numata et al.

(10) Patent No.: US 10,474,059 B2
(45) Date of Patent: Nov. 12, 2019

(54) DEVELOPING UNIT AND PROCESS CARTRIDGE

(71) Applicant: CANON KABUSHIKI KAISHA, Tokyo (JP)

(72) Inventors: Tetsuya Numata, Suntou-gun (JP); Naoya Asanuma, Susono (JP); Toru Oguma, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/833,686

(22) Filed: Dec. 6, 2017

(65) Prior Publication Data

US 2018/0164711 A1 Jun. 14, 2018

(30) Foreign Application Priority Data

Dec. 9, 2016 (JP) ..... 2016-239735

(51) Int. Cl.
*G03G 15/08* (2006.01)
*G03G 21/18* (2006.01)

(52) U.S. Cl.
CPC ..... *G03G 15/0813* (2013.01); *G03G 15/0808* (2013.01); *G03G 15/0812* (2013.01); *G03G 15/0817* (2013.01); *G03G 21/1814* (2013.01)

(58) Field of Classification Search
CPC ..... G03G 15/0813; G03G 15/0817; G03G 21/1814; G03G 15/0808; G03G 15/0812
USPC ..... 399/111
See application file for complete search history.

(56) References Cited

U.S. PATENT DOCUMENTS 5,461,465 A * 10/1995 Sunaga ..... G03G 15/0817 399/260
6,049,689 A * 4/2000 Ishii ..... G03G 15/0812 118/261
9,366,996 B2 * 6/2016 Harada ..... G03G 15/0817
2004/0208668 A1 * 10/2004 Kurihara ..... G03G 15/0817 399/102

FOREIGN PATENT DOCUMENTS

JP 02043582 A * 2/1990
JP 06337583 A * 12/1994
JP 2002-148939 A 5/2002

* cited by examiner

*Primary Examiner* — Susan S Lee
(74) *Attorney, Agent, or Firm* — Canon U.S.A., Inc. I.P. Division

(57) ABSTRACT

A developing unit includes an elastic member that is disposed nearer a middle portion in a rotational axis direction in relation to an edge portion seal member disposed between a developing roller and a developer container, in an edge portion of a regulation member in a rotational axis direction, and contacts a confronting surface at a side opposite to a contact portion in a developing blade, wherein the developing roller, the developing blade, and the elastic member are arranged so as to make contact with one another in sequence in a normal direction in the contact portion of the developing roller.

10 Claims, 12 Drawing Sheets

DEVELOPING UNIT AND PROCESS CARTRIDGE

BACKGROUND OF THE INVENTION

Field of the Invention

The present disclosure relates to a developing unit and a process cartridge to be used in an electrophotographic image forming apparatus.

Description of the Related Art

In an electrophotographic image forming apparatus (hereinafter referred to as an image forming apparatus), an electrophotographic photosensitive drum is uniformly charged as an image bearing member. The electrophotographic photosensitive drum generally has a drum shape. The charged electrophotographic photosensitive drum is selectively exposed to light, so that an electrostatic latent image (an electrostatic image) is formed on the electrophotographic photosensitive drum. Subsequently, the electrostatic latent image formed on the electrophotographic photosensitive drum is developed as a toner image with toner serving as developer retained by a developing roller. After the toner image formed on the electrophotographic photosensitive drum is transferred to a recording medium such as a recording sheet and a plastic sheet, heat and pressure are applied to the toner image transferred to the recording medium to fix the toner image on the recording medium. Accordingly, the image is recorded on the recording medium.

In the image forming apparatus, maintenance of various process units and toner supply are generally necessary. The electrophotographic photosensitive drum, a charging unit, a cleaning unit, and a developing unit including a developing member are collected into a cartridge. The cartridge is formed as a process cartridge detachable from an image forming apparatus main body to facilitate the toner supply and the maintenance. Such a process cartridge has been put into practical use.

With this process cartridge system, a user can perform maintenance on the apparatus for oneself. Thus, the use of such a process cartridge can significantly enhance operability of the apparatus and provide the image forming apparatus with good usability. Hence, the process cartridge systems are widely used in the image forming apparatuses.

A photosensitive drum and a cleaning unit including a cleaning member can be coupled with a developing unit including a developing roller as a developer bearing member by using a coupling shaft. In such a case, the resultant unit is generally known as the aforementioned process cartridge.

There is a developing unit including a developing blade (a regulation member) for regulating a thickness of toner layer on a developing roller that bears toner (Japanese Patent Application Laid-Open No. 2002-148939). The developing blade has a length corresponding to an area contributing to image formation on a photosensitive drum with a predetermined width added in both edges in a longitudinal direction. Such a member as the developing blade is conventionally used.

In recent years, image forming apparatuses have been expected to get smaller. With such a recent demand, a cartridge is required to get smaller in which a length in a longitudinal direction is shorter. With this decrease in size of the cartridge, a width in both edges of an image forming region in the longitudinal direction is required to get shorter.

However, a developing blade has instances where contact pressure in an edge portion thereof in the longitudinal direction tends to be lower than that in a middle portion. In particular, when the middle portion of the developing blade is deformed, areas on both sides which are continuous with the middle portion in the longitudinal direction are deformed following the deformation of the middle portion. Such deformation can generate a large elastic force, thereby increasing a contact pressure between the developing blade and a developing roller. On the other hand, when an edge portion of the developing blade is deformed, only one area continuous with the edge portion in the longitudinal direction is deformed following the deformation of the edge portion. In this case, an elastic force is smaller than that generated in the middle portion, and a contact pressure between the developing blade and the developing roller is lower. Consequently, in the longitudinal direction, a contact pressure between the developing blade and the developing roller in the edge portion is lower than that in the middle portion, and the developing blade cannot contact the developing roller with a constant contact pressure.

SUMMARY OF THE INVENTION

The present disclosure is directed to a developing unit and a process cartridge that reduce differences in contact pressure between a regulation member and a developer bearing member in a longitudinal direction by assisting a contact pressure of a longitudinal edge portion of the regulation member relative to the developer bearing member, so that generation of a defective image can be suppressed.

According to an aspect of the present disclosure, a developing unit includes a developer container configured to store developer, a developer bearing member configured to bear the developer, the developer bearing member being rotatably fixed to the developer container, a regulation member configured to regulate a thickness of a layer of the developer borne by the developer bearing member, the regulation member being fixed to the developer container and contacting the developer bearing member in a contact portion, an edge portion seal member disposed between the developer bearing member and the developer container in an edge portion of the developer bearing member in a rotation axial direction, the edge portion seal member being disposed outside an edge portion of the regulation member in the rotational axis direction, and an elastic member that is disposed nearer a middle portion in the rotation axial direction in relation to the edge portion seal member, in the edge portion of the regulation member in the rotational axis direction, and contacts a confronting surface at a side opposite to the contact portion in the regulation member. The developer bearing member, the regulation member, and the elastic member are arranged so as to make contact with one another in sequence in a normal direction in the contact portion of the developer bearing member.

According to another aspect of the present disclosure, a process cartridge detachable from a main body of an image forming apparatus includes an image bearing member, a charging device configured to charge the image bearing member, a cleaning device configured to act on the image bearing member, and a developing device configured to develop an image on the image bearing member, wherein the developing device includes a developer container configured to store developer, a developer bearing member configured to bear the developer, the developer bearing member being rotatably fixed to the developer container, a regulation member configured to regulate a thickness of a layer of the developer borne by the developer bearing member, the regulation member being fixed to the developer container and contacting the developer bearing member in a contact portion, an edge portion seal member disposed between the developer bearing member and the developer container in an edge portion of the developer bearing member in a rotation axial direction, the edge portion seal member being disposed outside an edge portion of the regulation member in the rotational axis direction, and an elastic member that is disposed nearer a middle portion in the rotational axis direction in relation to the edge portion seal member, in the edge portion of the regulation member in the rotational axis direction, and contacts a confronting surface at a side opposite to the contact portion in the regulation member. In the process cartridge, the developer bearing member, the regulation member, and the elastic member are arranged so as to make contact with one another in sequence in a normal direction in the contact portion of the developer bearing member.

Further features of the present disclosure will become apparent from the following description of exemplary embodiments with reference to the attached drawings.

DESCRIPTION OF THE EMBODIMENTS

Hereinafter, various exemplary embodiments are described in detail with reference to the drawings. A rotational axis of an electrophotographic photosensitive drum represents a longitudinal direction. Moreover, in the longitudinal direction, a side at which the electrophotographic photosensitive drum receives a driving force from an image forming apparatus main body is a drive side, and a side opposite to the drive side is a non-drive side.

Figure 2:
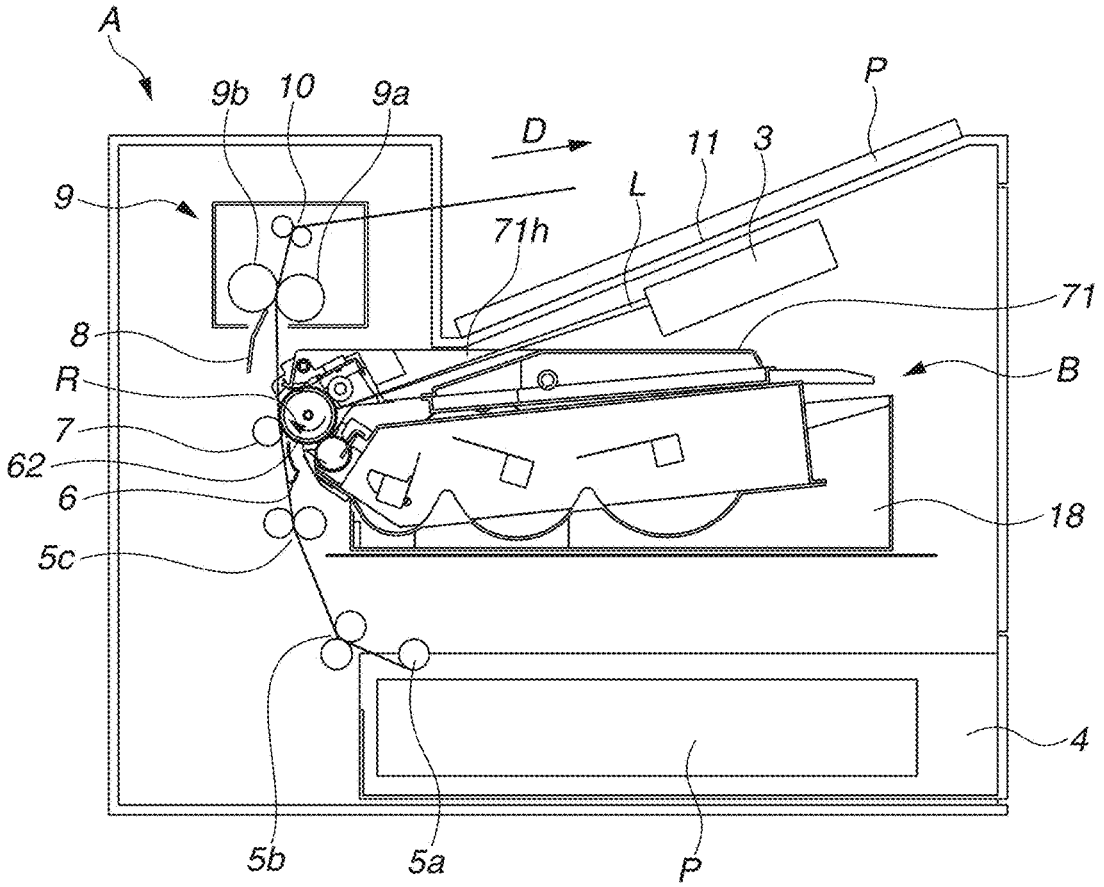
FIG. 2 is a sectional view illustrating the process cartridge and a main body of an image forming apparatus according to the exemplary embodiment.
Figure 3:
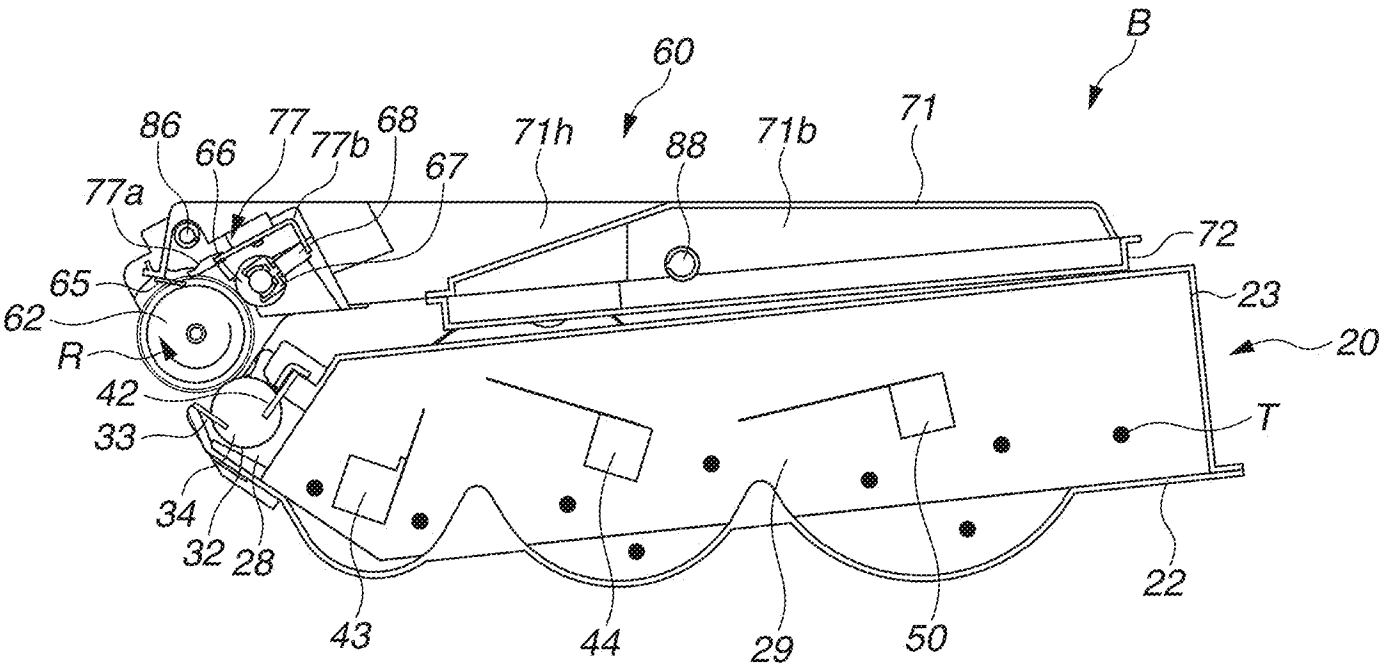
FIG. 3 is a sectional view illustrating the process cartridge according to the exemplary embodiment.

An overall configuration of an image forming apparatus and an image forming process are described with reference to FIGS. 2 and 3. FIG. 2 is a sectional view of an image forming apparatus main body (hereinafter referred to as an apparatus main body A) of the image forming apparatus and a process cartridge (hereinafter referred to as a cartridge B) according to a first exemplary embodiment. FIG. 3 is a sectional view of the cartridge B. Herein, the apparatus main body A is a portion excluding the cartridge B from the image forming apparatus.

The process cartridge is integration of an electrophotographic photosensitive drum and a process unit that acts on the electrophotographic photosensitive drum, and is detachable from the apparatus main body A. In the present exemplary embodiment, the process cartridge is formed by integrating an electrophotographic photosensitive drum and a developing unit as a process unit as an example. The image forming apparatus is an apparatus for forming an image on a recording medium by using an electrophotographic image forming system. Examples of such image forming apparatuses include an electrophotographic copying machine, an electrophotographic printer (e.g., a light emitting diode (LED) printer, a laser beam printer), a facsimile machine, and a word processor.

<Overall Configuration of Image Forming Apparatus>

The image forming apparatus illustrated in FIG. 2 is a laser beam printer that employs electrophotographic techniques and includes the cartridge B detachable from the apparatus main body A. When the cartridge B is attached to the apparatus main body A, an exposure device 3 (a laser scanner unit) is set. The exposure device 3 forms a latent image on an electrophotographic photosensitive drum 62 (hereinafter referred to as a drum 62) which functions as an image bearing member that is a rotator disposed in the cartridge B. Moreover, the apparatus main body A includes a sheet tray 4 disposed below the cartridge B. The sheet tray 4 stores a recording medium (hereinafter referred to as a sheet P) on which an image is to be formed.

Moreover, the apparatus main body A includes a pickup roller 5*a*, a sheet feed roller pair 5*b*, a conveyance roller pair 5*c*, a transfer guide 6, a transfer roller 7, a conveyance guide 8, a fixing device 9, a discharge roller pair 10, and a discharge tray 11 that are arranged in sequence along a conveyance direction D of the sheet member P. The fixing device 9 includes a heat roller 9*a* and a pressure roller 9*b*.

<Image Forming Process>

Next, an image forming process is described. The drum 62 is rotated in a direction R (FIG. 3) at a predetermined circumferential velocity (a predetermined process speed) based on a print start signal. A charging roller 66 to which a bias voltage is applied contacts an outer peripheral surface of the drum 62 to uniformly charge the outer peripheral surface of the drum 62.

The exposure device 3 outputs a laser beam L according to image information. The laser beam L passes through a laser opening 71*h* provided in a cleaning frame 71 of the cartridge B, and is shed onto the outer peripheral surface of the drum 62 in a scanning manner, so that an electrostatic latent image corresponding to the image information is formed on the outer peripheral surface of the drum 62.

Meanwhile, as illustrated in FIG. 3, in a developing unit 20 as a developing device, toner (developer) T inside a toner chamber 29 is agitated and conveyed by rotation of a first conveyance member 43, a second conveyance member 44, and a third conveyance member 50, and is fed to a toner supply chamber 28. The toner T is borne on a surface of a developing roller (a developer bearing member) 32 by a magnetic force of a magnetic roller (a fixed magnet) 34. The developing roller 32 is rotatably fixed to a developer container 23. Subsequently, the toner T on the surface of the developing roller 32 is triboelectrically charged by a developing blade (regulation member) 42. At the same time, a layer thickness of the toner T on the peripheral surface of the developing roller 32 is regulated by the developing blade 42. The electrostatic latent image formed on the drum 62 is developed with the toner T, which is provided on the peripheral surface of the developing roller 32 and has the layer with regulated thickness. Thus, the electrostatic latent image is rendered visible as a toner image.

In addition, as illustrated in FIG. 2, a sheet P is fed from the sheet tray 4 in a lower portion of the apparatus main body A by the pickup roller 5*a*, the sheet feed roller pair 5*b*, and the conveyance roller pair 5*c*. The sheet P is fed in timing with output of the laser beam L. Then, the sheet P is conveyed to a transfer position between the drum 62 and the transfer roller 7 via the transfer guide 6. In the transfer position, the toner images are sequentially transferred to the sheet P from the drum 62.

The sheet P with the transferred toner image is separated from the drum 62 and then conveyed along the conveyance guide 8 to the fixing device 9. Subsequently, the sheet P passes a nip portion between the heat roller 9*a* and the pressure roller 9*b* of the fixing device 9. In the nip portion, the fixing device 9 performs pressure heat fixing to fix the toner image on the sheet P. After the fixing processing, the sheet P is conveyed to the discharge roller pair 10 and discharged to the discharge tray 11.

Meanwhile, as illustrated in FIG. 3, after the toner image is transferred to the sheet P, a cleaning member 77 as a blade removes residual toner from the outer peripheral surface of the drum 62. Thus, the drum 62 can be used in an image forming process again. The toner removed from the drum 62 is stored in a toner collection chamber 71*b* of a cleaning unit 60 as a photosensitive unit.

Accordingly, each of the charging roller 66, the developing roller 32, the transfer roller 7, and the cleaning member 77 is a process unit that acts on the drum 62.

<Attachment and Detachment of Cartridge>

Next, attachment and detachment of the cartridge B to and from the apparatus main body A is described with reference to FIGS. 4A, 4B, and 4C.

Figure 4A:
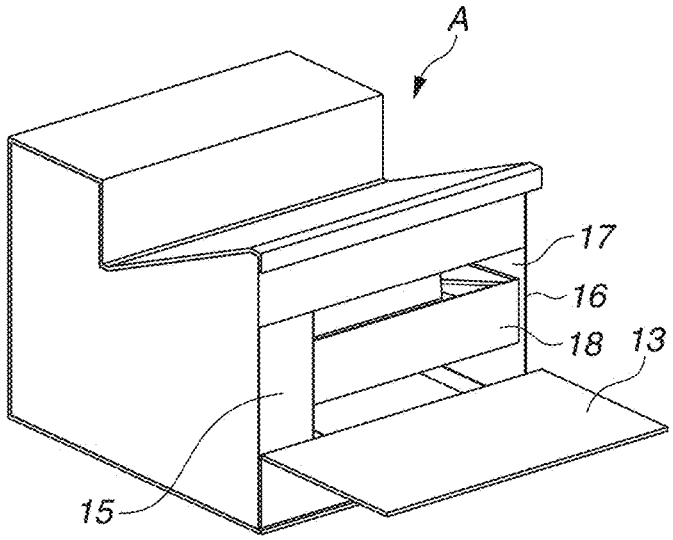
FIGS. 4A to 4C are schematic diagrams illustrating attachment and detachment of the process cartridge to and from the image forming apparatus according to the exemplary embodiment.
Figure 4B:
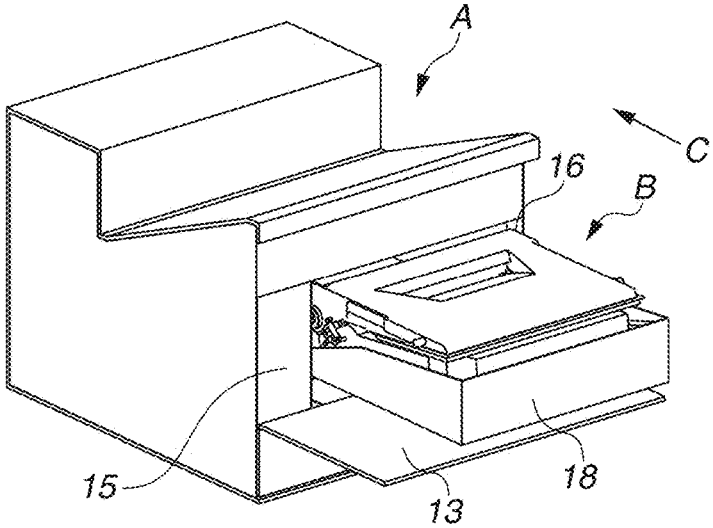
Figure 4C:
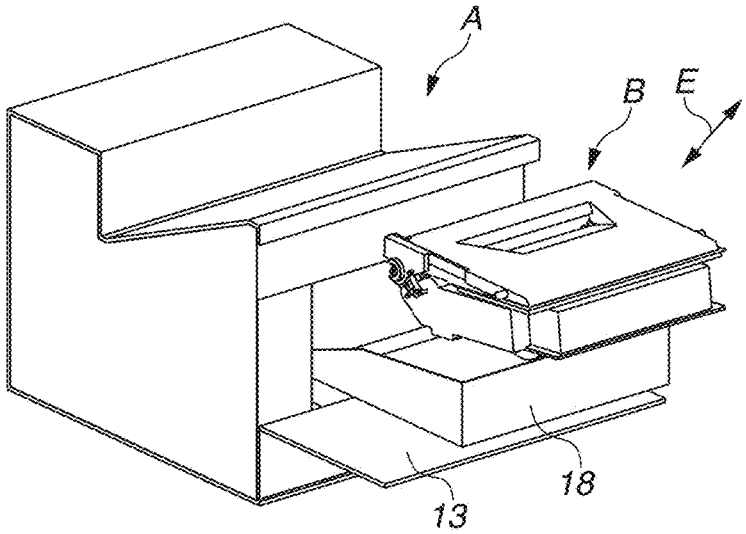

FIG. 4A is a perspective view of the apparatus main body A with an open/close door 13 opened for attachment/detachment of the cartridge B. FIG. 4B is a perspective view of the apparatus main body A and the cartridge B in a state where the open/close door 13 is opened for attachment/detachment of the cartridge B and a cartridge tray 18 is pulled out. FIG. 4C is a perspective view of the apparatus main body A and the cartridge B when the cartridge B is being attached/detached in a state where the open/close door 13 is opened and the tray 18 is pulled out. The cartridge B is detachable along a detachable direction E with respect to the tray 18.

The open/close door 13 is rotatably mounted on the apparatus main body A. When the open/close door 13 is opened, there is a cartridge insertion opening 17. In the cartridge insertion opening 17, the tray 18 for attachment of the cartridge B to the apparatus main body A is slidably supported by a drive-side side plate 15 and a nondrive-side side plate 16. When the tray 18 is pulled out to a predetermined position, the cartridge B can be attached/detached. The cartridge B is attached along a guide rail (not illustrated) in a direction C illustrated in FIG. 4B in the apparatus main body A in a state where the cartridge B is placed on the tray 18.

<Overall Configuration of Cartridge>

Figure 5:
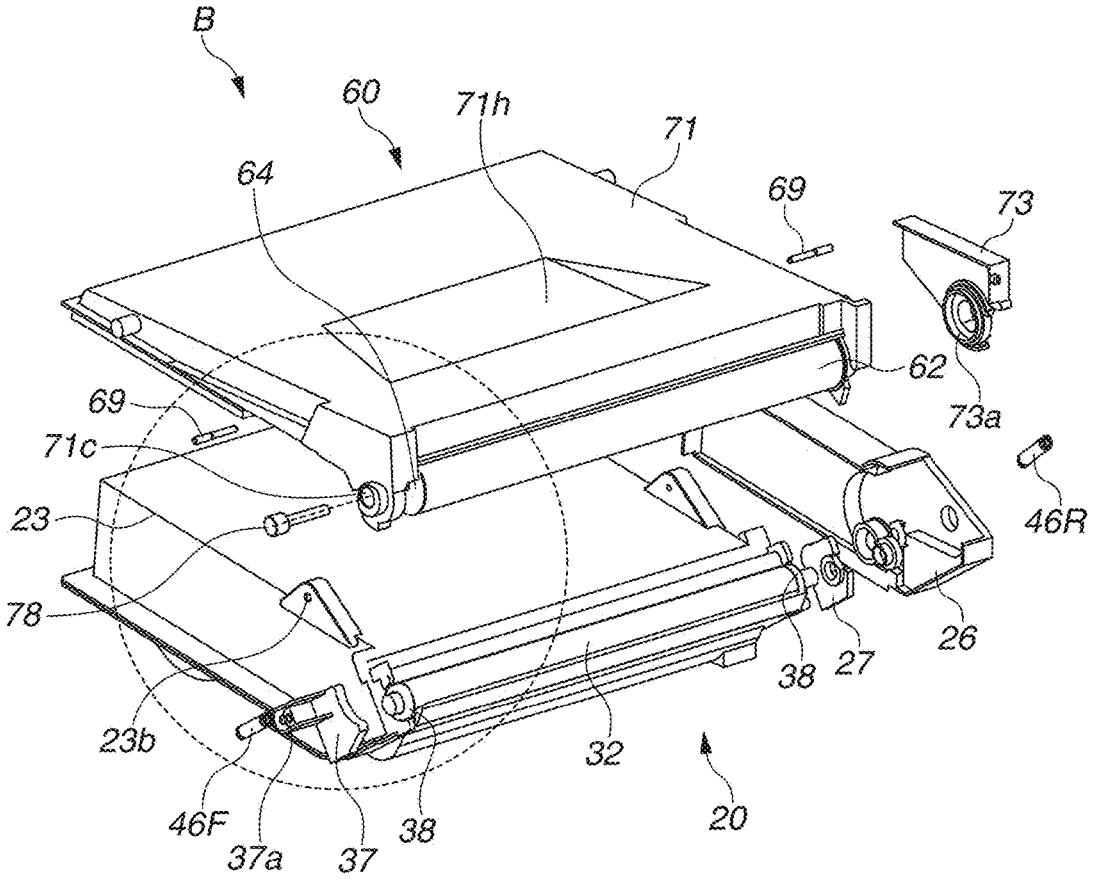
FIG. 5 is an exploded view illustrating the process cartridge according to the exemplary embodiment.
Figure 6:
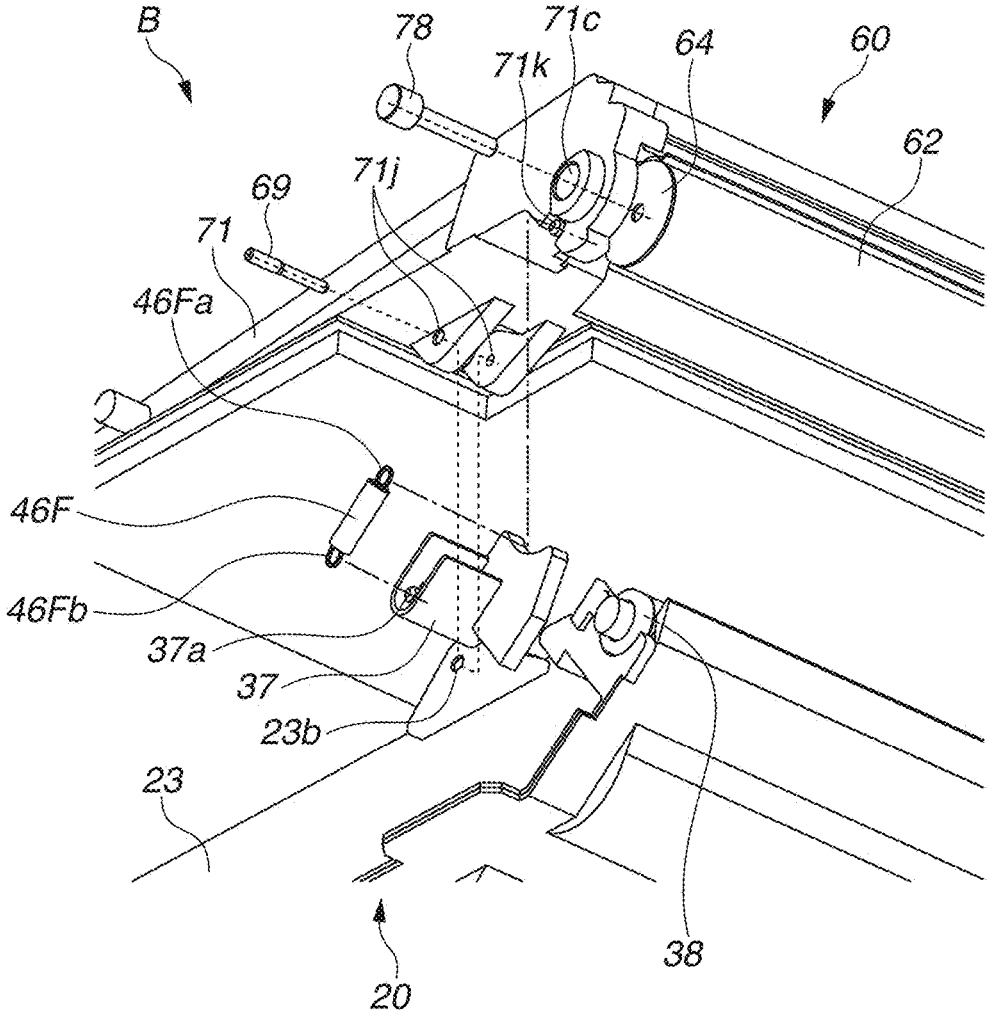
FIG. 6 is an exploded view illustrating the process cartridge according to the exemplary embodiment.

Next, an overall configuration of the cartridge B is described with reference to FIGS. 3 and 5 through 9B. FIG. 3 is a sectional view of the cartridge B, and each of FIGS. 5 through 8 is a perspective view of a configuration of the cartridge B. FIG. 6 is an enlarged partial view of a portion indicated by a dotted line in FIG. 5 as seen from a different angle, whereas FIG. 8 is an enlarged partial view of a portion indicated by a dotted line in FIG. 7 as seen from a different angle. In the present exemplary embodiment, a description of a screw for coupling one component with another is omitted.

The cartridge B includes the cleaning unit 60 and the developing unit 20. As illustrated in FIG. 3, the cleaning unit 60 includes the drum 62, the charging roller 66, the cleaning member 77, the cleaning frame 71, and a cover member 72. The cleaning frame 71 supports the drum 62, the charging roller 66, and the cleaning member 77. The cover member 72 is fixed to the cleaning frame 71 by welding, for example. In the cleaning unit 60, each of the charging roller 66 and the cleaning member 77 is arranged in contact with an outer peripheral surface of the drum 62.

The cleaning member 77 includes a rubber blade (a rubber member) 77*a* and a supporting portion 77*b*. The rubber blade 77*a* serves as an elastic portion of a blade-shaped elastic member made of rubber as an elastic material, and the supporting portion 77*b* is fixed to a fixing surface 71*m* of the cleaning frame 71 to support the rubber blade 77*a*. The rubber blade 77*a* contacts the drum 62 in a direction opposite to a rotation direction of the drum 62. That is, the rubber blade 77*a* contacts the drum 62 such that a leading edge portion of the rubber blade 77*a* faces an upstream side of the drum 62 in the rotation direction.

Figure 8:
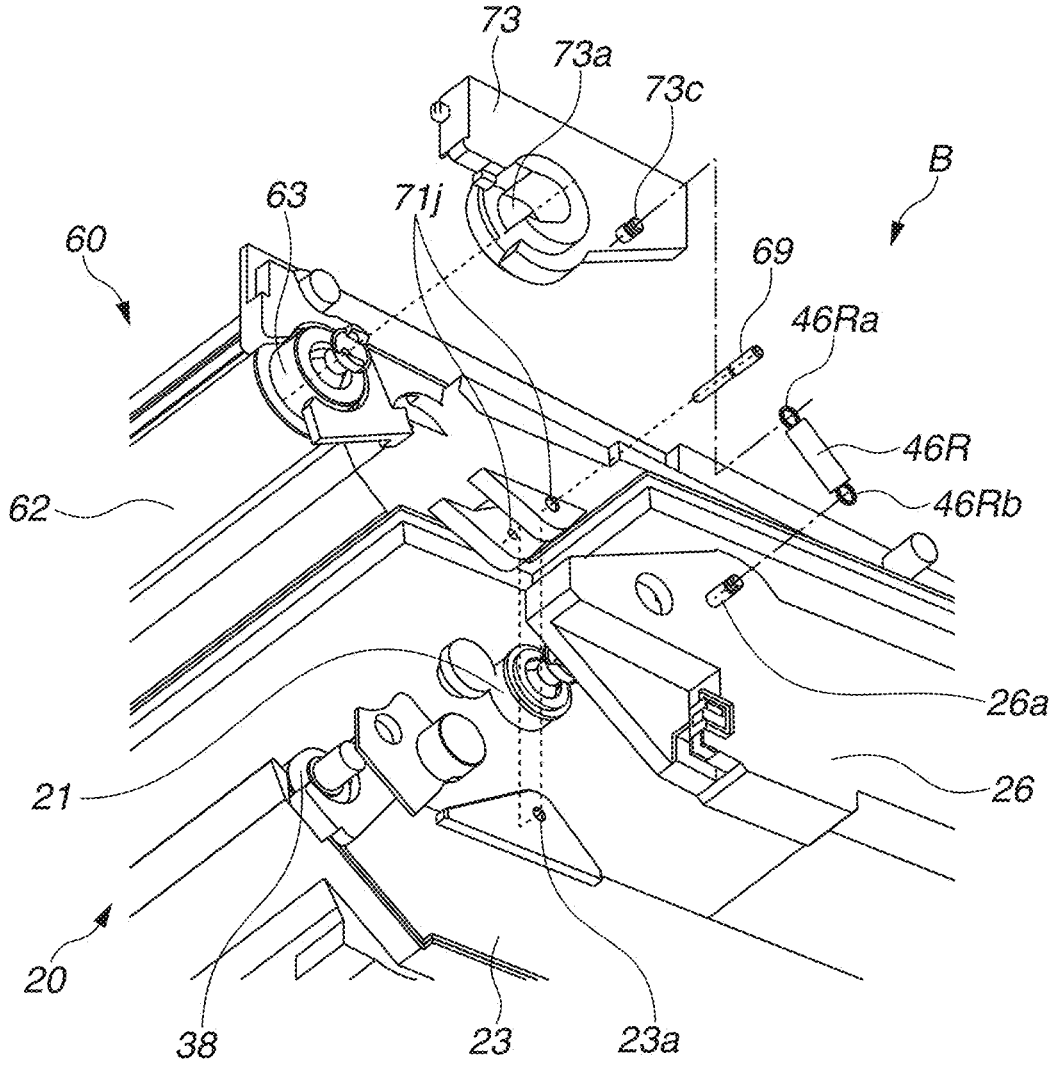
FIG. 8 is an exploded view illustrating the process cartridge according to the exemplary embodiment.
Figure 9A:
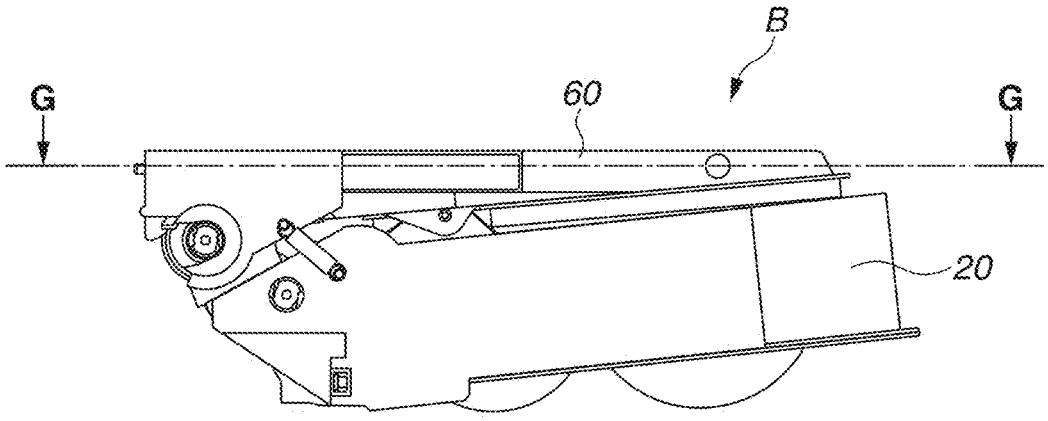
FIGS. 9A and 9B are diagrams illustrating a cleaning container of the process cartridge according to the exemplary embodiment.
Figure 9B:
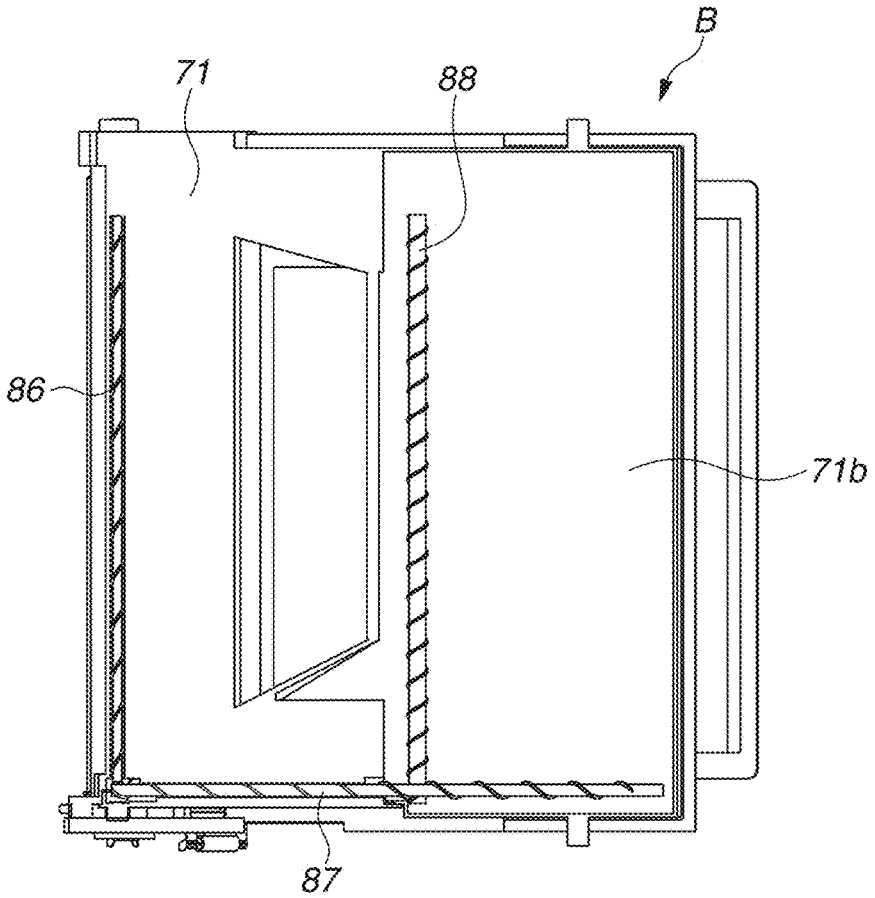

FIG. 9A is a side view of the cartridge B as seen from one edge in a longitudinal direction. FIG. 9B is a sectional view along the line G-G in the cleaning frame 71 illustrated in FIG. 9A. As illustrated in FIGS. 3, 9A, and 9B, the toner removed from the surface of the drum 62 by the cleaning member 77 is conveyed by a first screw 86, a second screw 87, and a third screw 88 as toner conveyance members. The toner removed from the surface of the drum 62 is stored in the toner collection chamber 71*b* formed by the cleaning frame 71 and the cover member 72 connected to the cleaning frame 71. The first screw 86 is rotated by a driving force transmitted from a coupling 21 illustrated in FIG. 8 by a gear (not illustrated). The second screw 87 is rotated by driving forces from the first screw 86 and the third screw 88 is rotated by driving forces from the second screw 87 respectively. The first screw 86 is arranged near the drum 62, the second screw 87 is arranged in a longitudinal edge portion of the cleaning frame 71, and the third screw 88 is arranged in the toner collection chamber 71*b*. Herein, a rotation axis of each of the first screw 86 and the third screw 88 is parallel to a rotation axis of the drum 62, whereas a rotation axis of the second screw 87 is perpendicular to the rotation axis of the drum 62.

As illustrated in FIG. 3, a drum contact sheet 65 for preventing leakage of toner from the cleaning frame 71 is disposed in a rim portion of the cleaning frame 71 so as to contact the drum 62.

The drum 62 receives a driving force from a main body drive motor (not illustrated) as a driving source, so that the drum 62 is rotated in the direction R illustrated in FIG. 3 according to an image forming operation. In both edge portions of the cleaning frame 71 in the longitudinal direction (in a rotational axis direction of the drum 62), the charging roller 66 is rotatably mounted on the cleaning unit 60 via a charging roller bearing 67. The charging roller bearing 67 is pressed toward the drum 62 by an urging member 68, so that the charging roller 66 is pressed against the drum 62. The charging roller 66 is rotated by rotation of the drum 62.

As illustrated in FIG. 3, the developing unit 20 includes the developing roller 32, a developer container 23 that supports the developing roller 32 and stores toner, and the developing blade 42. The magnet roller 34 is disposed inside the developing roller 32. The developing blade 42 for regulating a toner layer on the developing roller 32 is disposed in the developing unit 20. As illustrated in FIGS. 5 and 6, the developing roller 32 includes a spacing member 38 that is mounted on each of both edge portions of the developing roller 32. The spacing member 38 and the drum 62 contact each other, so that the developing roller 32 is retained with a little space from the drum 62. As illustrated in FIG. 3, a developing roller contact sheet 33 for preventing leakage of toner from the developing unit 20 is disposed in a rim portion of a bottom member 22 so as to contact the developing roller 32. The first conveyance member 43, the second conveyance member 44, and the third conveyance member 50 are arranged in the toner chamber 29 formed by the developer container 23 and the bottom member 22. The first conveyance member 43, the second conveyance member 44, and the third conveyance member 50 agitate the toner stored in the toner chamber 29, and convey the toner to a toner supply chamber 28.

Figure 7:
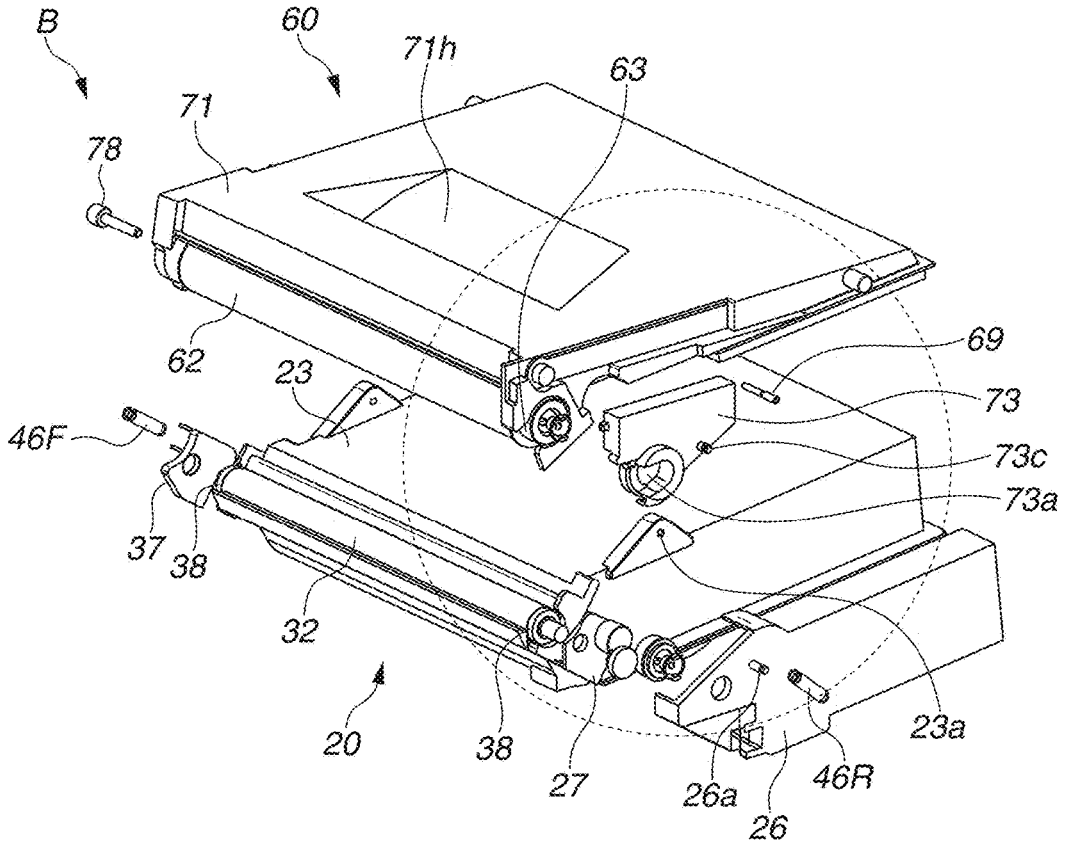
FIG. 7 is an exploded view illustrating the process cartridge according to the exemplary embodiment.

As illustrated in FIGS. 5 and 7, the cartridge B is integration of the cleaning unit 60 and the developing unit 20.

The cleaning unit 60 includes the cleaning frame 71, the cover member 72, the drum 62, a drum bearing 73 for rotatably supporting the drum 62, and a drum shaft 78. As illustrated in FIG. 8, on the drive side of the drum 62, a drive side drum flange 63 disposed on the drive side is rotatably supported by a hole portion 73*a* of the drum bearing 73. On the other hand, on the nondrive side as illustrated in FIGS. 5 and 6, the drum shaft 78 forcibly inserted into a hole portion 71*c* of the cleaning frame 71 rotatably supports a hole portion of a nondrive side drive flange 64.

As illustrated in FIGS. 3, 5, and 7, the developing unit 20 includes the bottom member 22, the developer container 23, a drive-side development side member 26, the developing blade 42, and the developing roller 32. The developing roller 32 is rotatably mounted on the developer container 23 by bearing members 27 and 37 arranged in both respective edges.

As illustrated in FIGS. 5 through 8, the cleaning unit 60 and the developing unit 20 are rotatably coupled with each other by a coupling pin 69, thereby forming the cartridge B. More specifically, the developer container 23 has a first support hole 23*a* and a second support hole 23*b* that are arranged in both respective edge portions of the developing unit 20 in the longitudinal direction. The cleaning frame 71 has a first hanging hole 71*i* and a second hanging hole 71*j* that are arranged in both respective edge portions of the cleaning unit 60 in the longitudinal direction. The coupling pins 69 forcibly inserted into and fixed to the first hanging hole 71*i* and the second hanging hole 71*j* are fit into the first support hole 23*a* and the second support hole 23*b*, so that the cleaning unit 60 and the developing unit 20 are rotatably connected to each other.

Further, a first hole portion 46Ra of a drive-side urging member 46R is hooked to a boss of the drum bearing 73, and a second hole portion 46Rb is hooked to a boss 26*a* of the drive-side development side member 26.

Further, a first hole portion 46Fa of a nondrive-side urging member 46F is hooked to a boss 71*k* of the cleaning frame 71, and a second hole portion 46Fb is hooked to a boss 37*a* of the bearing member 37.

In the present exemplary embodiment, each of the drive-side urging member 46R and the nondrive-side urging member 46F is formed of a tension spring. The developing unit 20 is urged toward the cleaning unit 60 by urging forces of the springs, so that the developing roller 32 is reliably pushed toward a direction of the drum 62. The developing roller 32 is retained with a predetermined space from the drum 62 by the spacing member 38 mounted on each of the both edge portions of the developing roller 32.

<Detailed Configuration of Developing Unit>

Figure 1A:
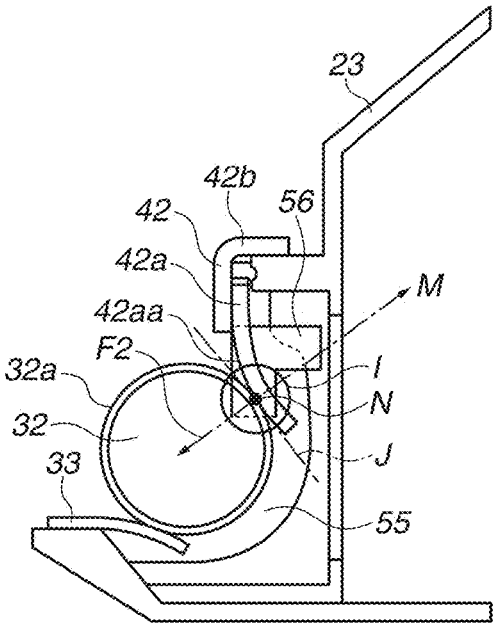
FIGS. 1A to 1D are diagrams illustrating a developing unit of a process cartridge according to an exemplary embodiment.
Figure 1B:
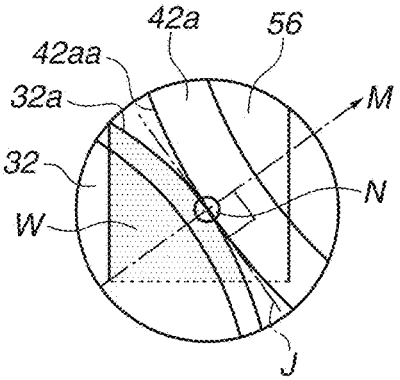
Figure 1C:
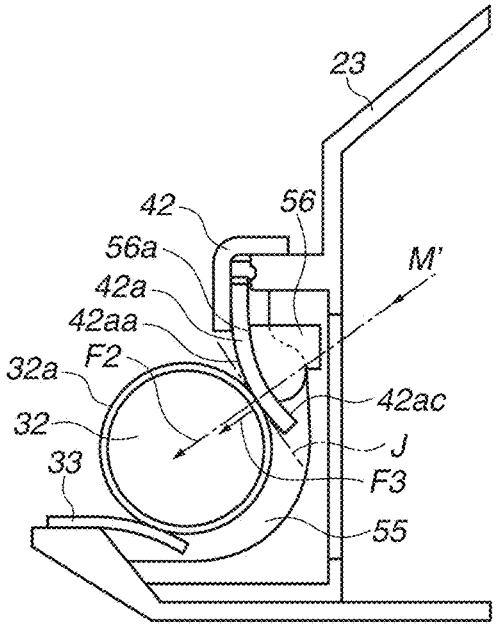
Figure 1D:
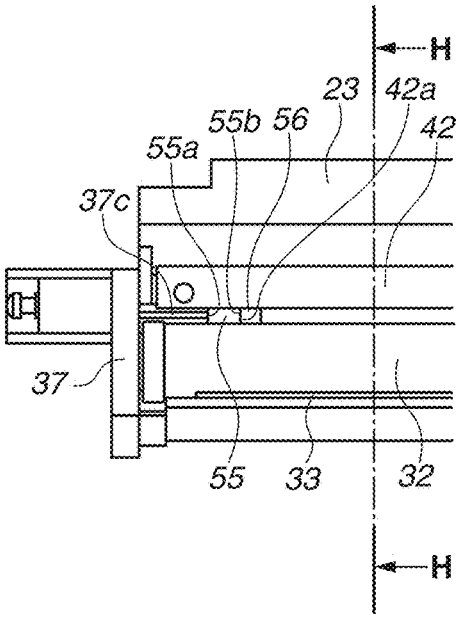

Next, a configuration of the developing unit 20 is described in detail with reference to FIGS. 1A through 1D and FIGS. 10A through 12B. FIG. 1D is a top view illustrating one portion of a nondrive side of the developing unit 20, and FIG. 1C is a sectional view along the line H-H of FIG. 1D. FIG. 1A is a sectional view along the line H-H of FIG. 1D and illustrates an arrangement relation between the developing roller 32 and an elastic member 56 prior to deformation. FIG. 1B is an enlarged partial view of an area I of FIG. 1A. FIGS. 10A through 12B illustrate configurations when the developing unit 20 is assembled in order. Since the nondrive side and the drive side of the developing unit 20 have symmetrical shapes, a configuration of the nondrive-side is hereinafter described.

As illustrated in FIG. 1A through 1D, the developing blade 42 for regulating a thickness of a developer layer on the developing roller 32 is fixed to the developer container 23. The developing blade 42 includes a rubber blade 42*a* that contacts the developing roller 32, and a supporting portion 42*b* that supports a rubber blade 42*a* and is fixed to the developer container 23. In an edge portion of the developer container 23 in the longitudinal direction, an edge portion seal member 55 is disposed between the developing roller 32 and the developer container 23, and further between the developing blade 42 and the developer container 23, outside an edge portion of the developing blade 42 in the longitudinal direction. The edge portion seal member 55 seals a portion between the developing roller 32 and the developer container 23, and a portion between the developing blade 42 and the developer container 23. An elastic member 56 is disposed in a middle portion of the developing unit 20 in the longitudinal direction with respect to the edge portion seal member 55. In the longitudinal direction, the elastic member 56 is bonded and fixed so as to be laid across a surface of the developer container 23 and a surface of the edge portion seal member 55, facing the middle portion of the developing unit 20. Accordingly, the elastic member 56 is disposed so as to contact a confronting surface 42*ac* at a side opposite to a contact portion N that contacts the developing roller 32. Thus, the confronting surface 42*ac* is provided in the rubber blade 42*a* (the developing blade 42).

The elastic member 56 has a shape extending from the developer container 23 side toward the rubber blade 42*a* side and further extending from a fixed edge of the rubber blade 42*a* to a free edge, that is, the elastic member 56 is substantially L-shape. The elastic member 56 is deformed together with deformation of the rubber blade 42*a* caused by attachment of the developing roller 32. That is, before the developing roller 32 is mounted, the elastic member 56 is arranged with one portion thereof entering an entry area W of the developing roller 32 side from a position corresponding to an outer peripheral surface 32*a* including a portion to be the contact portion N between the developing roller 32 and the developing blade 42 when the developing roller 32 is arranged. Accordingly, after the developing roller 32 is mounted, the elastic member 56 is deformed in a direction M toward the rubber blade 42*a* in a normal direction perpendicular to a tangent J in the contact portion N. That is, in the contact portion N, the elastic member 56 is deformed further in the direction M from a state in which the confronting surface 42*ac* of the rubber blade 42*a* contacts a contact surface 56*a* of the elastic member 56 in the contact portion N, to a state illustrated in FIG. 1C. As a result, in a normal direction in the contact portion N between the developing roller 32 and the developing blade 42, the developing roller 32, the rubber blade 42*a*, and the elastic member 56 are in a contacting state with one another.

According to such a configuration, an elastic force of the elastic member 56 can generate a contact pressure F3 toward a direction M' (a direction opposite to the direction M indicated by the arrow) in a normal direction of the tangent in the contact portion N between the developing roller 32 and the developing blade 42. The contact pressure F3 can act on a contact pressure F2 so as to assist the contact pressure F2 in an edge portion in the longitudinal direction with respect to the developing roller 32 via the developing blade 42. As a result, in the longitudinal direction, the contact pressure of the developing blade 42 with respect to the developing roller 32 can be prevented from being lower in the edge portion than a middle portion of the developing blade 42, and reduction in the differences in contact pressure between the developing blade 42 and the developing roller 32 can prevent generation of a defective image.

Figure 10A:
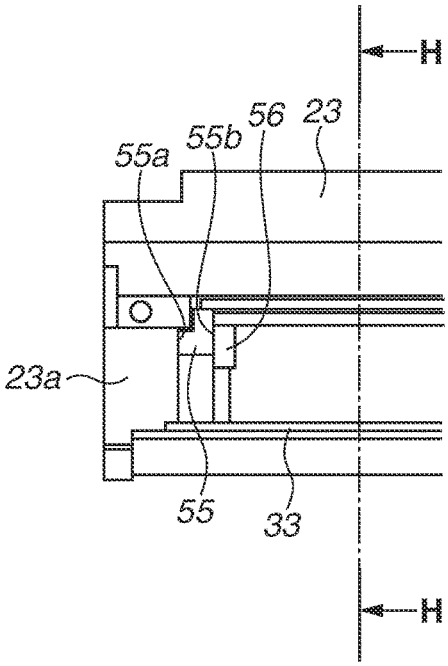
FIGS. 10A to 10C are diagrams illustrating a seal configuration in the developing unit of the process cartridge according to the exemplary embodiment.
Figure 10B:
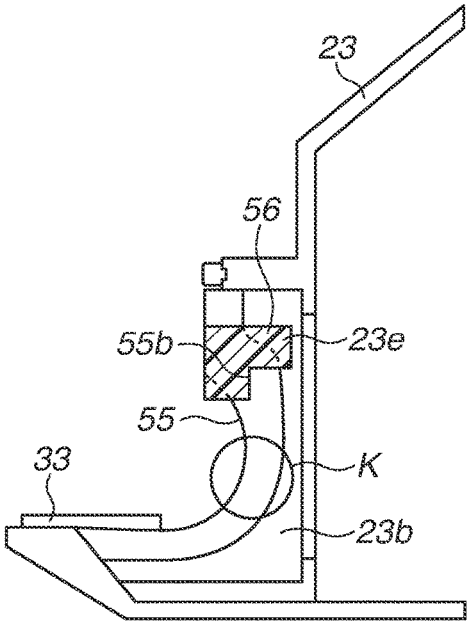
Figure 10C:
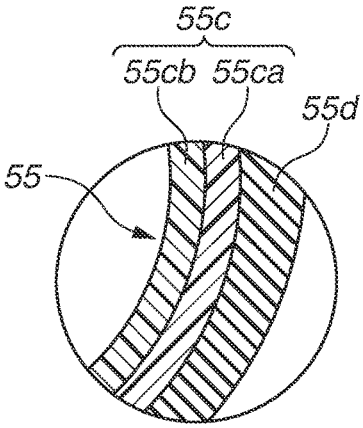

Next, assembly of the developing unit 20 is described with reference to FIGS. 1A through 1D and FIGS. 10A through 12B. FIG. 10A is a top view illustrating one portion of a nondrive side of the developer container 23 with the edge portion seal member 55 and the elastic member 56 attached. FIG. 10B is a sectional view along the line H-H of FIG. 10A. FIG. 10C is an enlarged partial view of an area K of FIG. 10B. The area K indicates a configuration of the edge portion seal member 55.

As illustrated in FIGS. 10A and 10B, the edge portion seal member 55 is first attached by following a seating surface 23*d* on an arc provided in the developer container 23. The edge portion seal member 55, as illustrated in FIG. 10B, includes a surface layer 55*c* and an intermediate layer 55*d*. The intermediate layer 55*d* is a foam made of a material such as polyurethane, and the surface layer 55*c* includes a foundation cloth 55*ca* and a fiber layer 55*cb* including pile yarn raised from the foundation cloth 55*ca*. Next, in the longitudinal direction, the elastic member 56 is attached and fixed across an inner edge surface 55*b* of the edge portion seal member 55 and an inner edge surface 23*e* of the developer container 23. Each of the inner edge surfaces 55*b* and 23*e* is oriented toward the middle portion of the developing unit 20 in the longitudinal direction. The elastic member 56 is a foam made of a material such as polyurethane similar to the intermediate layer 55*d*. Therefore, since the elastic member 56 is formed of only a foam made of a material such as polyurethane, the elastic member 56 is softer than the edge portion seal member 55.

Figure 11A:
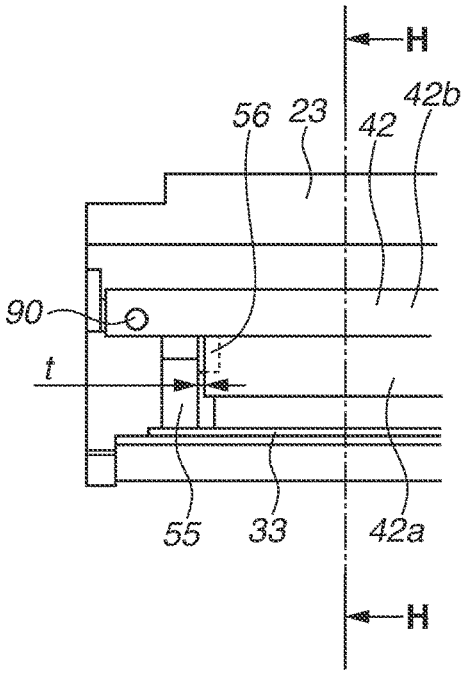
FIGS. 11A and 11B are diagrams illustrating an assembly process of the developing unit of the process cartridge according to the exemplary embodiment.
Figure 11B:
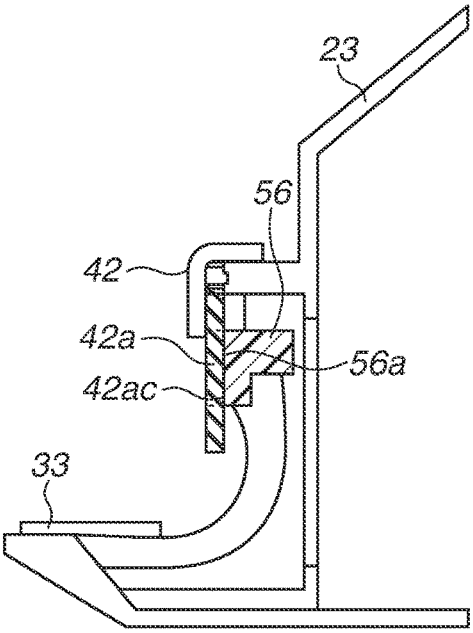

Next, mounting of the developing blade 42 is described with reference to FIGS. 11A and 11B. FIG. 11A is a top view illustrating one portion of a nondrive side of the developer container 23 with the developing blade 42 attached. FIG. 11B is a sectional view along the line H-H of the FIG. 11A. As illustrated in FIGS. 11A and 11B, the developing blade 42 is fixed and mounted on the developer container 23 with a screw 90. In particular, the developing blade 42 includes the rubber blade 42*a* and a supporting member 42*b*. The rubber blade 42*a* serves as a blade-shaped elastic portion made of rubber as an elastic material, and the supporting member 42*b* as a supporting portion supports the rubber blade 42*a*. The supporting member 42*b* is fixed to the developer container 23 with the screw 90 in a state where a seal member is interposed between the developing blade 42 and the developer container 23, so that the developing blade 42 is mounted on the developer container 23. Herein, the developing blade 42 is fixed in a state where a clearance t is created between the rubber blade 42*a* and the edge portion seal member 55 in the longitudinal direction. When the developing blade 42 is mounted on the developer container 23, the rubber blade 42*a* presses the elastic member 56 against the developer container 23. Thus, the elastic member 56 is deformed. That is, the contact surface 56*a* of the elastic member 56 and the confronting surface 42*ac* of the rubber blade 42*a* contact each other.

Figure 12A:
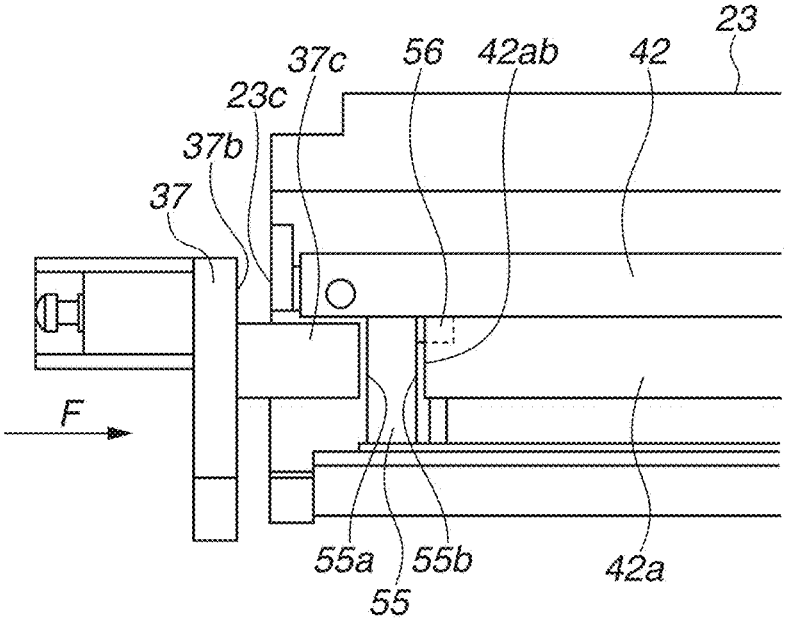
FIGS. 12A and 12B are diagrams illustrating an assembly process of a developing unit of a process cartridge according to a modification example.
Figure 12B:
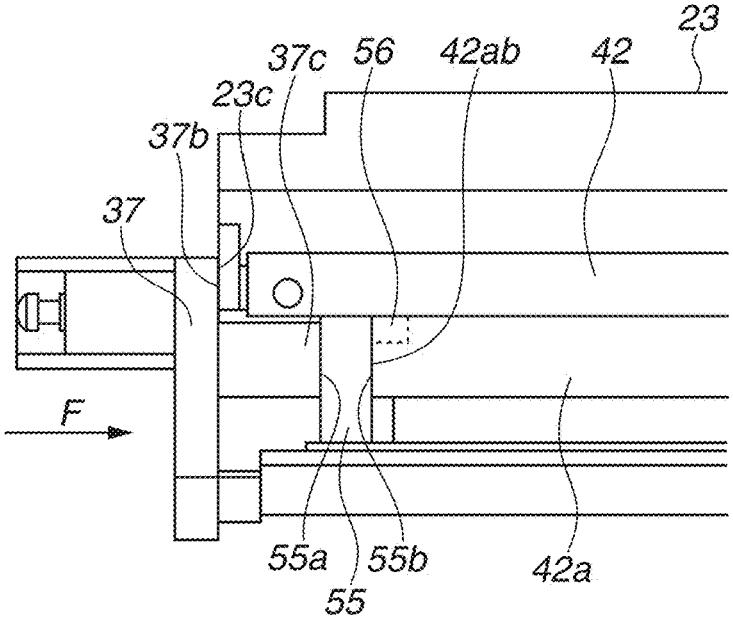

As illustrated in FIGS. 12A and 12B, the bearing member 37 is attached to the developer container 23 to form the developing unit 20. FIG. 12A is a top view illustrating one portion of a nondrive side of the developer container 23 before attachment of the bearing member 37. FIG. 12B is a top view illustrating one portion of a nondrive side of the developer container 23 after attachment of the bearing member 37. In practice, the bearing member 37 includes a bearing for the developing roller 32, and the bearing member 37 is mounted on the developer container 23 in a state in which the developing roller 32 is rotatably supported. However, the developing roller 32 is not illustrated in FIGS. 12A and 12B for the sake of simplicity.

As illustrated in FIGS. 12A and 12B, the bearing member 37 is inserted in a direction F from an edge portion. The bearing member 37 is inserted until a longitudinal positioning surface 37*b* provided in the bearing member 37 contacts an edge surface 23*c* of the developer container 23. Before the longitudinal positioning surface 37*b* contacts the edge surface 23*c* of the developer container 23, a pressing member 37*c* as an edge portion seal pressing member formed in the bearing member 37 contacts an outer edge surface 55*a* of the edge portion seal member 55. When the bearing member 37 is further inserted, the outer edge surface 55*a* of the edge portion seal member 55 receives a pressing force in the direction F by the pressing member 37*c*. Thus, the edge portion seal member 55 is urged toward the rubber blade 42*a*. Accordingly, when the bearing member 37 is inserted until the longitudinal positioning surface 37*b* provided in the bearing member 37 contacts the edge surface 23*c* of the developer container 23, the inner edge surface 55*b* of the edge portion seal member 55 contacts the longitudinal edge surface 42*ab* of the rubber blade 42*a*. As a result, the clearance t between the longitudinal edge surface 42*ab* of the rubber blade 42*a* and the inner edge surface 55*b* of the edge portion seal member 55 is sealed, thereby preventing toner leakage from a boundary between the rubber blade 42*a* and the edge portion seal member 55.

In FIGS. 12A and 12B, the developing roller 32 is omitted. However, as illustrated in FIG. 1D, the developer container 23 is mounted with the bearing member 37 such that the developing roller 32 is rotatably supported by the bearing member 37 inserted from the edge portion and fixed. Thus, the developing unit 20 is completed.

Accordingly, the edge portion seal member 55 is disposed to contact the developer container 23. Such arrangement can prevent leakage of toner from both edge portions. In addition, as illustrated in FIG. 1, a contact surface 42*aa* of the rubber blade 42*a* and an outer peripheral surface 32*a* of the developing roller 32 contact each other in the contact portion N under the contact pressure F2 generated by the elastic force of the rubber blade 42*a*. Further, before the developing roller 32 is mounted, the elastic member 56 is arranged with one portion thereof entering an entry area W of the developing roller side from a position corresponding to the outer peripheral surface 32*a* including a portion to be the contact portion N between the developing blade 42 and the developing roller 32 when the developing roller 32 is arranged. Accordingly, after the developing roller 32 is mounted, the elastic member 56 is provided in a state where the developing roller 32 contacts the rubber blade 42*a*, and the developing blade 42 contacts the elastic member 56, with one another in sequence in the normal direction M with respect to the tangent J in the contact portion N. As a result, the elastic member 56 is deformed in the direction M toward the rubber blade 42*a*, and the rubber blade 42*a* is urged toward the developing roller 32 in the contact portion N under the contact force F3 generated by an elastic force of the elastic member 56 toward the direction M' opposite to the direction M. The contact pressure F3 acts as a force for assisting the contact pressure F2 in an edge portion with respect to the developing roller 32 via the rubber blade 42*a*. Therefore, a contact pressure in the edge portion of the developing blade 42 with respect to the developing roller 32 becomes F2+F3. This enables the contact pressure in the edge portion to be substantially the same as a contact pressure F1 in the longitudinal middle portion.

Accordingly, one portion of the elastic member 56 enters the entry area W of the developing roller 32 side from a position corresponding to the outer peripheral surface 32*a* including the contact portion N when the developing roller 32 is provided. This can assist an edge portion contact pressure of the developing blade 42 with respect to the developing roller 32. Thus, differences in contact pressure between the developing roller 32 and the developing blade 42 in the longitudinal direction can be reduced, and the contact pressure can be uniformed across the longitudinal direction. Therefore, by assisting a contact pressure of a longitudinal edge portion of a regulation member with respect to a developer bearing member, differences in contact pressure between the developer bearing member and the regulation member is reduced in the longitudinal direction, thereby providing a developing unit and a process cartridge by which generation of a defective image is prevented.

In the above description, the edge portion seal member 55 is pressed by the pressing member 37*c*. However, the exemplary embodiment can be applied to a configuration in which the pressing member 37*c* is not disposed.

Further, the description has been made using the process cartridge including the developing unit 20. However, the exemplary embodiment can be applied to a developing cartridge including only the developing unit 20, that is, a configuration in which the developing unit 20 as the developing cartridge is detachable from the image forming apparatus main body.

Functions, materials, shapes, and relative arrangements of components described in the modification example are not intended to limit the scope of the present disclosure, unless otherwise specified.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-239735, filed Dec. 9, 2016, which is hereby incorporated by reference herein in its entirety.

What is claimed is:

1. A developing unit comprising:

a developer container configured to store developer;

a developer bearing member configured to bear the developer, the developer bearing member being rotatably supported by the developer container;

a regulation member configured to contact the developer bearing member in a contact portion and regulate a thickness of a layer of the developer borne by the developer bearing member, the regulation member being supported by the developer container;

an edge portion seal member disposed between the developer bearing member and the developer container in an edge portion of the developer bearing member in a rotation axial direction, the edge portion seal member being disposed outside an edge portion of the regulation member in the rotational axis direction; and an elastic member that is attached on and across an inner edge surface of the edge portion seal member and an inner edge surface of the developer container, and the elastic member contacting a confronting surface of the regulation member at one side opposite to the other side where the contact portion is provided, wherein the developer bearing member, the regulation member, and the elastic member are arranged so as to make contact with one another in sequence in a normal direction in the contact portion of the developer bearing member.

2. The developing unit according to claim 1, further comprising an edge portion seal pressing member configured to press an outer edge surface of the edge portion seal member to bring the edge portion seal member into contact with the regulation member, in the rotational axis direction of the developer bearing member.

3. The developing unit according to claim 1, wherein the elastic member includes a polyurethane foam.

4. The developing unit according to claim 1, wherein the edge portion seal member includes a surface layer that contacts the developer bearing member, and an intermediate layer, wherein the surface layer includes a foundation cloth, and a fiber layer held by the foundation cloth, and wherein the intermediate layer includes a polyurethane foam.

5. The developing unit according to claim 1, wherein the regulation member includes:

a supporting member fixed to the developer container; and a rubber member that is fixed to the supporting member and contacts the developer bearing member in the contact portion.

6. A process cartridge detachable from a main body of an image forming apparatus, the process cartridge comprising:

an image bearing member;

a charging device configured to charge the image bearing member;

a cleaning device configured to act on the image bearing member; and a developing device configured to develop an image on the image bearing member, wherein the developing device includes:

a developer container configured to store developer;

a developer bearing member configured to bear the developer, the developer bearing member being rotatably supported by the developer container;

a regulation member configured to contact the developer bearing member in a contact portion and regulate a thickness of a layer of the developer borne by the developer bearing member, the regulation member being supported by the developer container;

an edge portion seal member disposed between the developer bearing member and the developer container in an edge portion of the developer bearing member in a rotation axial direction, the edge portion seal member being disposed outside an edge portion of the regulation member in the rotational axis direction; and an elastic member that is attached on and across an inner edge surface of the edge portion seal member and an inner edge surface of the developer container, and the elastic member contacting a confronting surface of the regulation member at one side opposite to the other side when the contact portion is provided, wherein the developer bearing member, the regulation member, and the elastic member are arranged so as to make contact with one another in sequence in a normal direction in the contact portion of the developer bearing member.

7. The process cartridge according to claim 6, further comprising an edge portion seal pressing member configured to press an outer edge surface of the edge portion seal member to bring the edge portion seal member into contact with the regulation member, in the rotational axis direction of the developer bearing member.

8. The process cartridge according to claim 6, wherein the elastic member includes a polyurethane foam.

9. The process cartridge according to claim 6, wherein the edge portion seal member includes a surface layer that contacts the developer bearing member, and an intermediate layer, wherein the surface layer includes a foundation cloth, and a fiber layer held by the foundation cloth, and wherein the intermediate layer includes a polyurethane foam.

10. The process cartridge according to claim 6, wherein the regulation member includes:

a supporting member fixed to the developer container; and a rubber member that is fixed to the supporting member and contacts the developer bearing member in the contact portion.

* * * * *